US006067774A

United States Patent [19]

Sauer

[11] Patent Number: 6,067,774

[45] Date of Patent: May 30, 2000

[54] PROCESS AND DEVICE FOR PACKAGING FOODSTUFFS HAVING AN APERTURE

[75] Inventor: Heinrich Sauer, Butzbach, Germany

[73] Assignee: Poly-Clip System GmbH & Co. KG, Frankfurt am Main, Germany

[21] Appl. No.: 09/125,996

[22] PCT Filed: Jan. 24, 1997

[86] PCT No.: PCT/EP97/00360

§ 371 Date: Aug. 28, 1998

§ 102(e) Date: Aug. 28, 1998

[87] PCT Pub. No.: WO97/32782

PCT Pub. Date: Sep. 12, 1997

[30] Foreign Application Priority Data

Mar. 4, 1996 [DE] Germany ..... 196 07 998

[51] Int. Cl.[7] ..... B65B 49/00

[52] U.S. Cl. ..... 53/409; 53/427; 53/204; 426/129; 426/410

[58] Field of Search ..... 53/459, 433, 409, 53/427, 204; 426/129, 410

[56] References Cited

U.S. PATENT DOCUMENTS

| | | | |
|---|---|---|---|
| 4,014,153 | 3/1977 | Wilson | 53/21 |
| 4,033,382 | 7/1977 | Eichin | 138/118.1 |
| 4,034,536 | 7/1977 | Mahaffy et al. | 53/22 |
| 5,054,270 | 10/1991 | McMahon | 53/552 |
| 5,709,068 | 1/1998 | Bylenga | 53/449 |

*Primary Examiner*—William Hong
*Attorney, Agent, or Firm*—Norris McLaughlin & Marcus, P.A.

[57] ABSTRACT

Process and device for packaging foodstuffs having a recess, such as meats and sausages and gutted poultry, in which a previously sealed tubular section is taken through the aperture by means of an insertion pin, whereafter one end of the tubular section is turned back around the hollow body towards the other end in order to fully encase the foodstuff.

13 Claims, 6 Drawing Sheets

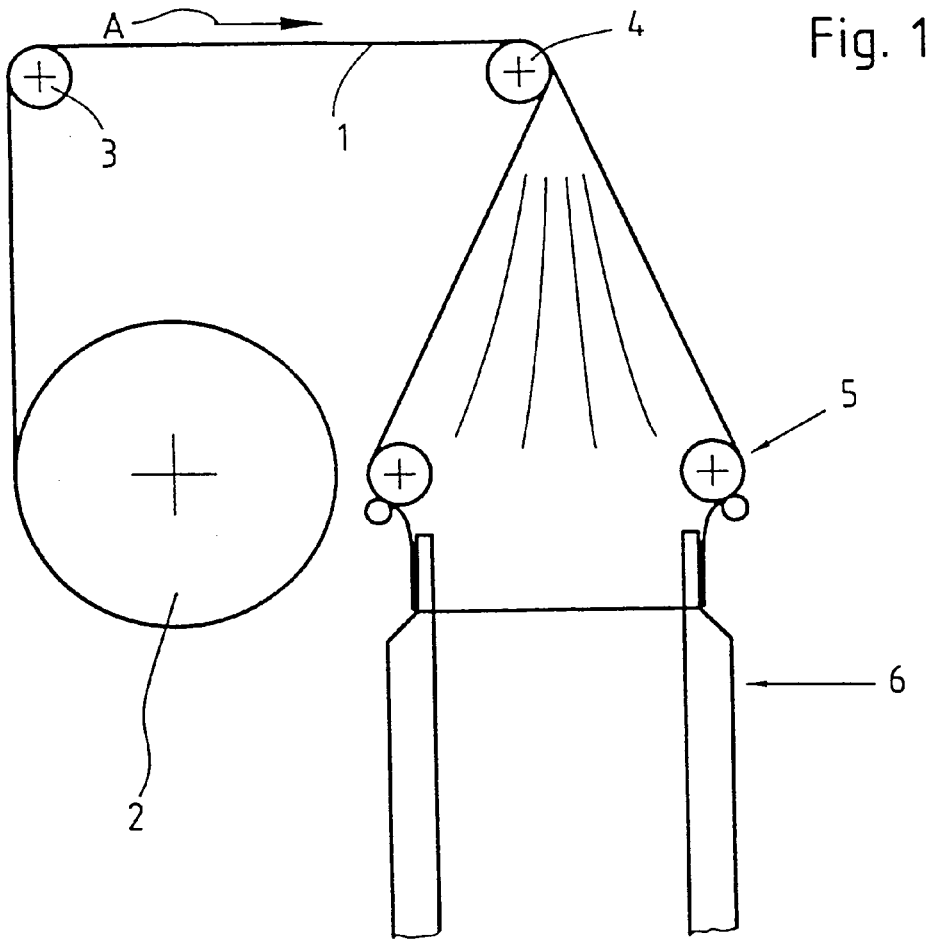
Fig. 1
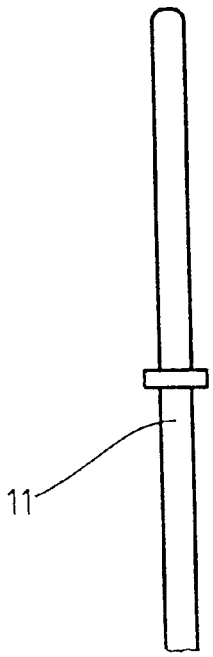

1
2
3
4
5
6
7
8
9
10
11
B

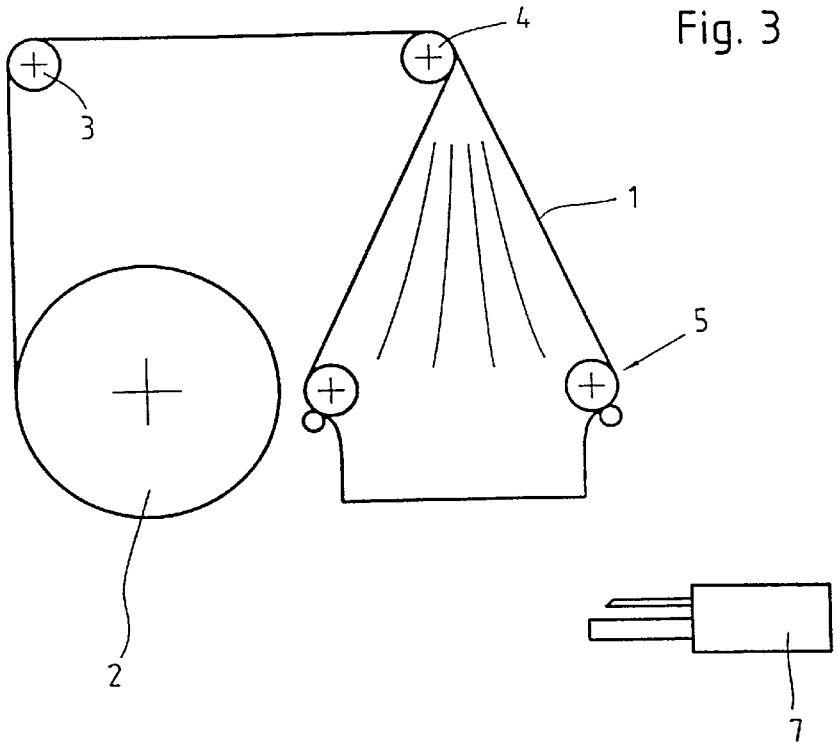
Fig. 3
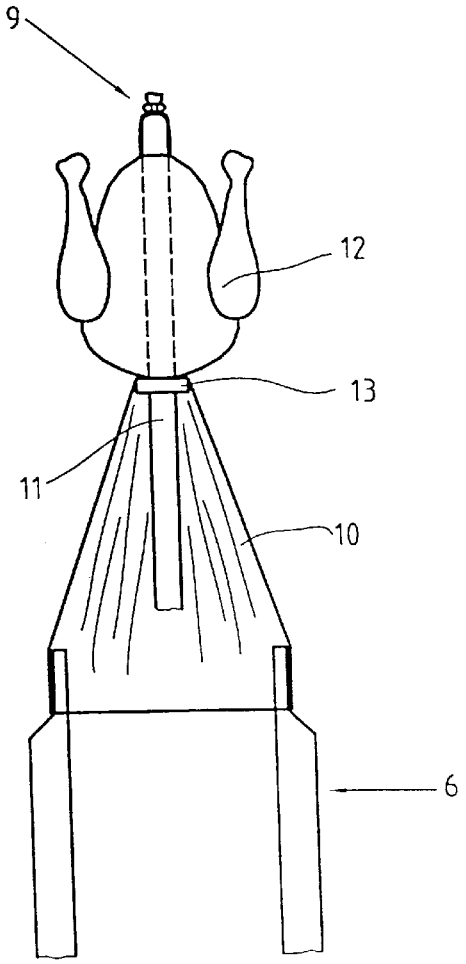

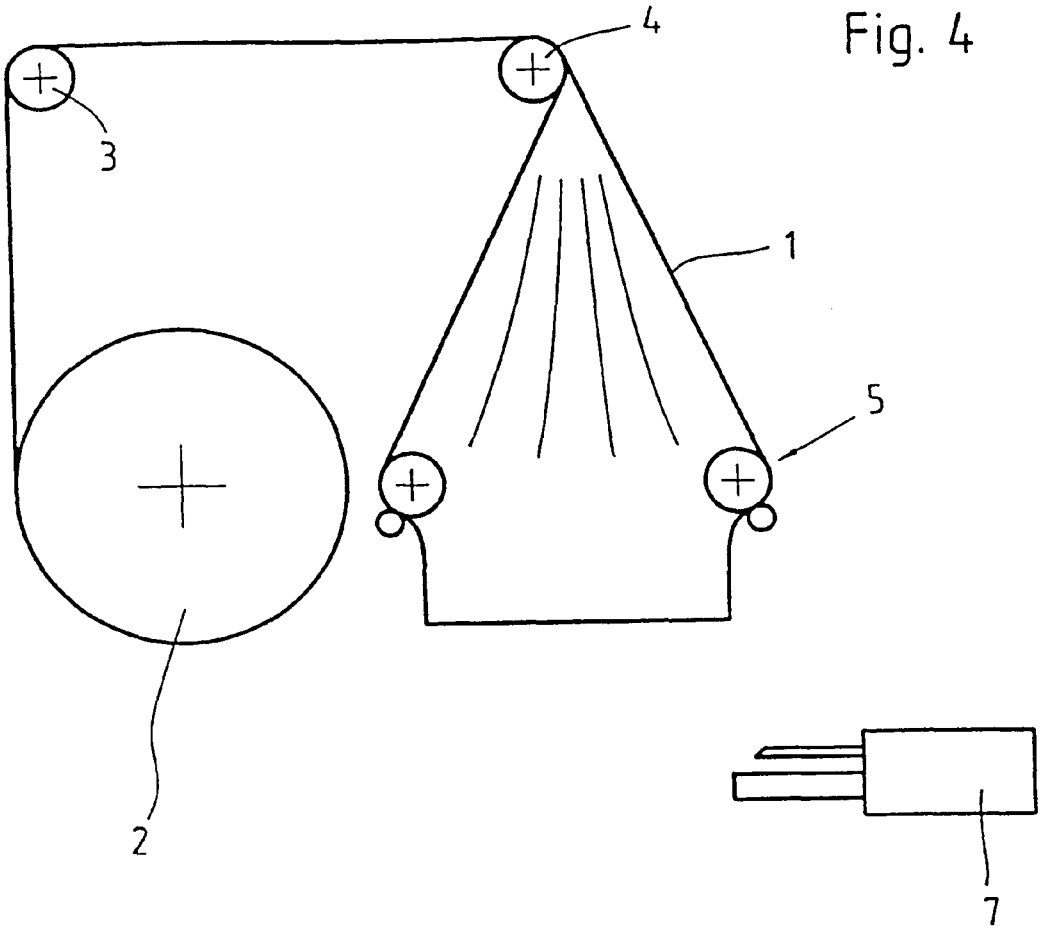
Fig. 4
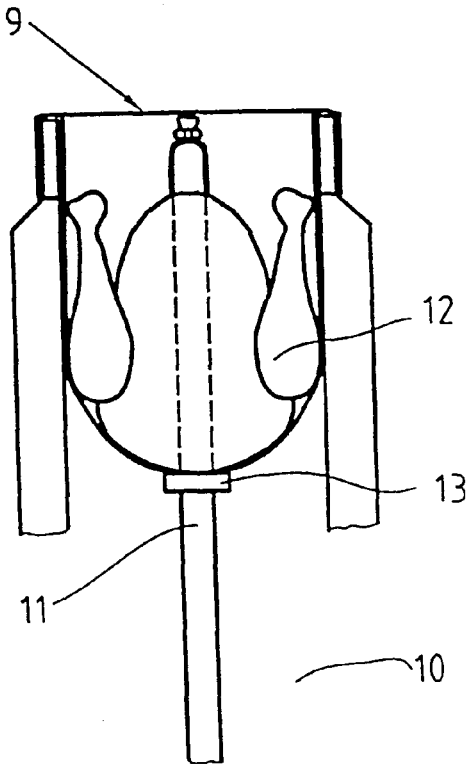

4
3
1
5
14
15
2
15
7
10
6
12
13
11

1
2
3
4
5
6
7
8
11
12
13
14
15
16

PROCESS AND DEVICE FOR PACKAGING FOODSTUFFS HAVING AN APERTURE

This invention relates to a process as well as a device for packaging foodstuffs having an aperture, in particular of meat and sausage products having an aperture as well as gutted poultry.

BACKGROUND OF THE INVENTION

When such meat and sausage products or poultry are not directly sold at the place of slaughter or production, they will be packaged, so that the goods can be handled more easily during their transport and possibly intended storage and do not go bad prematurely. Frequently, the already packaged foodstuffs are deep-frozen, so as to increase their durability. It is desired that the packaging material should cover both the outer surfaces of the foodstuff and the inner surfaces in the vicinity of the aperture.

In this connection it is known from U.S. Pat. No. 2,844,474 to pass a tubular section first through the aperture of the foodstuff, subsequently put the end that has been passed therethrough over the foodstuff and, possibly after an additional suction process, seal the tubular section by means of the other end of the tubular section that has not been passed therethrough. For an easier passage of the tubular section an insertion pin may be used. Having passed the tubular section through the aperture of the foodstuff, which mostly has only a very small diameter, so that as a result the tubular section likewise has only a small diameter after having been passed through the aperture, the tubular section must be expanded to a very large diameter for being put over the foodstuff. It turned out to be disadvantageous that the end of the tubular section that has been passed through the aperture of the foodstuff and is then put over the foodstuff can be seized only with difficulty due to its small diameter and can therefore be expanded only with great effort. This is aggravated in particular in that when passing the tubular section through the aperture the moisture from the foodstuff, which has already accumulated at the wall of the aperture, is absorbed by the end of the tubular section, so that the same conglutinates.

It is the object of the present invention to create a process and a device as described above, which provide for a simple and easy packaging of a foodstuff having an aperture.

SUMMARY OF THE INVENTION

As regards the process, the above object is solved according to the present invention by a process for packaging foodstuff having an aperture, which comprises providing a tubular section of packaging material having a sealed end and an open end, passing the sealed end through the aperture, and then bringing the open end over the foodstuff. Since that end of the tubular section is put over the foodstuff which is located opposite the end of the tubular section that has been passed through the aperture, the proposed solution provides for an easy seizing of the end of the tubular section to be put over the foodstuff, because it was not necessary to first compress the same to the small diameter of the hollow space in the foodstuff. Moreover, there is no longer the risk that the end to be put over the foodstuff will conglutinate due to the moisture absorbed while it is passed through the aperture, and therefore putting the end over the foodstuff can only be performed with great effort or not at all.

DETAILED DESCRIPTION

This procedure is made possible by the fact that the tubular section to be passed through the aperture is first of all sealed (whereas the remaining complete sealing will only be effected in a further sealing step when the other tubular section has been put over the foodstuff). On the other hand, in the process known from U.S. Pat. No. 2,844,474 the end of the tubular section that has been passed through the foodstuff and has been put over the foodstuff has been sealed together with the other end of the tubular section by means of a sealing member provided for both ends of the tubular section together. As in this case a double layer of tubular material must be sealed by the single sealing member, it may happen that despite the sealing member a connection exists between the interior of the bag thus formed from the tubular section and the surroundings, so that air and/or for instance putrefactive bacteria may get into the bag. Since it is provided in accordance with the invention that before passing the tubular section through the aperture, the end of the tubular section to be passed therethrough is sealed, it need no longer be sealed upon sealing the end of the tube passed through the aperture for being put over the foodstuff. It is advantageous when sealing the end of the tubular section to be passed through the aperture is effected before the tubular section is pulled over the insertion pin, so that it may serve as "stop" at the end of the insertion pin and thus fixes the tubular section in its position on the insertion pin.

It is in particular possible that before passing the tubular section through the aperture of the hollow body, the end of the tubular section to be put over the foodstuff is widened. As a result, putting the end of the tubular section over the foodstuff can easily be effected subsequent to passing the tubular section through the aperture of the foodstuff.

It may furthermore be provided that the end of the tubular section that has been widened before passing the tubular section through the aperture of the foodstuff is seized by a gripping means during or shortly after widening, and the tubular section is pulled over the insertion pin by means of the gripping means to such an extent that the rear end in pulling direction at least approximately rests against the rear end of the insertion pin in pulling direction. It is thus achieved in particular that widening the end of the tubular section to be put over the foodstuff can be maintained, while on the other hand an easy "threading" of the end of the tubular section to be passed through the foodstuff is made possible.

When the tubular section has been pulled over the insertion pin, the foodstuff may be pushed onto the insertion pin in pulling direction, or the insertion pin may be introduced into the provided foodstuff. The foodstuff should be pushed onto the insertion pin to such an extent, or the same should be introduced into the foodstuff to such an extent that the rear end of the insertion pin in pulling direction or the end of the insertion pin bearing the end of the tubular section that has been passed through the aperture protrudes from the aperture of the foodstuff.

When the foodstuff has been pushed onto the insertion pin or the insertion pin has been introduced into the foodstuff, a gripping means may seize the end of the tubular section to be put over the foodstuff, which end has possibly already been widened, and for enclosing the foodstuff guide this end up to at least the other end of the tubular section, so that the foodstuff is covered with the material of the tubular section both in the vicinity of its aperture and on its outside. There may be used the gripping means provided for pulling the tubular section over the insertion pin. Alternatively, there may be provided a separate gripping means, where the gripping means pulling the tubular section over the insertion pin transfers the possibly widened end of the tubular section to the first-mentioned gripping means and returns to its starting position, where it can already seize the next tubular section.

Along with or after putting the tubular section over the foodstuff, the end of the tubular section put over the foodstuff can be sealed by means of a sealing means. For this purpose it may be provided that for sealing the end of the tubular section put over the foodstuff the same is moved together with the foodstuff along the insertion pin such that the foodstuff together with this end of the tubular section protrudes beyond the end of the insertion pin, at which there is disposed the end of the tubular section that has been passed through the aperture.

It may furthermore be provided that the sealing means seizes the end of the tubular section guided around the foodstuff for being put over the same as well as the other end of the tubular section and seals at least the end of the tubular section guided around the foodstuff for being put over the same. For sealing purposes a welding or bonding process may be provided. It is particularly advantageous when the sealing means sets a sealing member, in particular a clip, for sealing the end of the tubular section guided over the foodstuff so as to be put over the same. Upon sealing the tubular section put over the foodstuff, protruding tubular material may be cut off by means of a provided cutting means. Before doing so, the air contained in the tubular section may be sucked off.

The tubular section may be produced in different ways. It is for instance possible that from a film material, in particular a film material suitable for roasting and/or cooking and/or freezing there is first of all formed a continuous tube, which is correspondingly cut into lengths. It is likewise possible that the tubular section is obtained from a continuous tubular material already formed, by cutting the same into lengths by means of a cutting means. It should be noted that the cutting means may also be used for cutting off protruding material upon sealing the end of the tubular section guided over the foodstuff so as to be put over the same.

In some cases it may be advantageous when upon packaging the foodstuff the same is subjected to a cooking or roasting process. In such case it is advantageous when the tubular section is obtained from a suitable film material, in particular a roasting film.

As regards the device, the above-mentioned object is solved by a device for packaging foodstuffs having an aperture, in particular meat and sausage products having an aperture as well as gutted poultry, preferably for carrying out the process disclosed herein, where an insertion pin (11) is provided, by means of which a tubular section (10) can be passed through the aperture of the foodstuff, wherein there is provided a sealing means (7) for sealing the end of the tubular section disposed at the free end of the insertion pin (11), and the end of the tubular section (10) which is disposed opposite the sealed end of the tubular section (10) can be put over the foodstuff (12) by means of a gripping means (6) seizing this end of the tubular section. The advantages are the same as explained above in conjunction with the inventive process. These advantages can apparently not be achieved with the much more complicated packaging machine for vehicle tires, which is known from the DE-OS 24 23 668.

Advantageous embodiments of the inventive device are provided wherein the device further comprises a means (5) for widening the end of the tubular section (10) to be put over the foodstuff (12). The insertion pin (11) advantageously comprises a stop (13) movable along the longitudinal axis of the insertion pin (11), preferably a stop ring. In a further advantageous embodiment, feeding rollers (2–4) are provided for feeding a continuous tubular material (1) to the gripping means (6), which supplies the tubular material (1) to a cutting means (7), which cuts off the tubular section (10) and possibly material protruding from the end of the tubular section (10), which has been passed over the foodstuff (12) so as to be put over the same, after the same has been sealed.

One embodiment of the present invention will subsequently be explained with reference to the enclosed drawings. FIGS. 1 to 6 illustrate the device in accordance with the invention in addition to a symbolic representation of individual process steps of the inventive process.

BRIEF DESCRIPTION OF THE DRAWINGS

As shown in FIG. 1, a packaging tube 1 is withdrawn from a roller 2 by a gripping means 6.

As shown in FIG. 3, the gripping means 6 has pulled the sealing packaging tube 1 over the insertion pin 11 to such an extent that the sealing point 9 touches the end of the insertion pin 11. A chicken 12 is pushed onto the insertion pin 11.

As shown in FIG. 4, the gripping means 6 has pushed the packaging tube 1 in the direction of the sealing point 9 to such an extent that the packaging tube 1 rests against the chicken 12.

Figure 2:
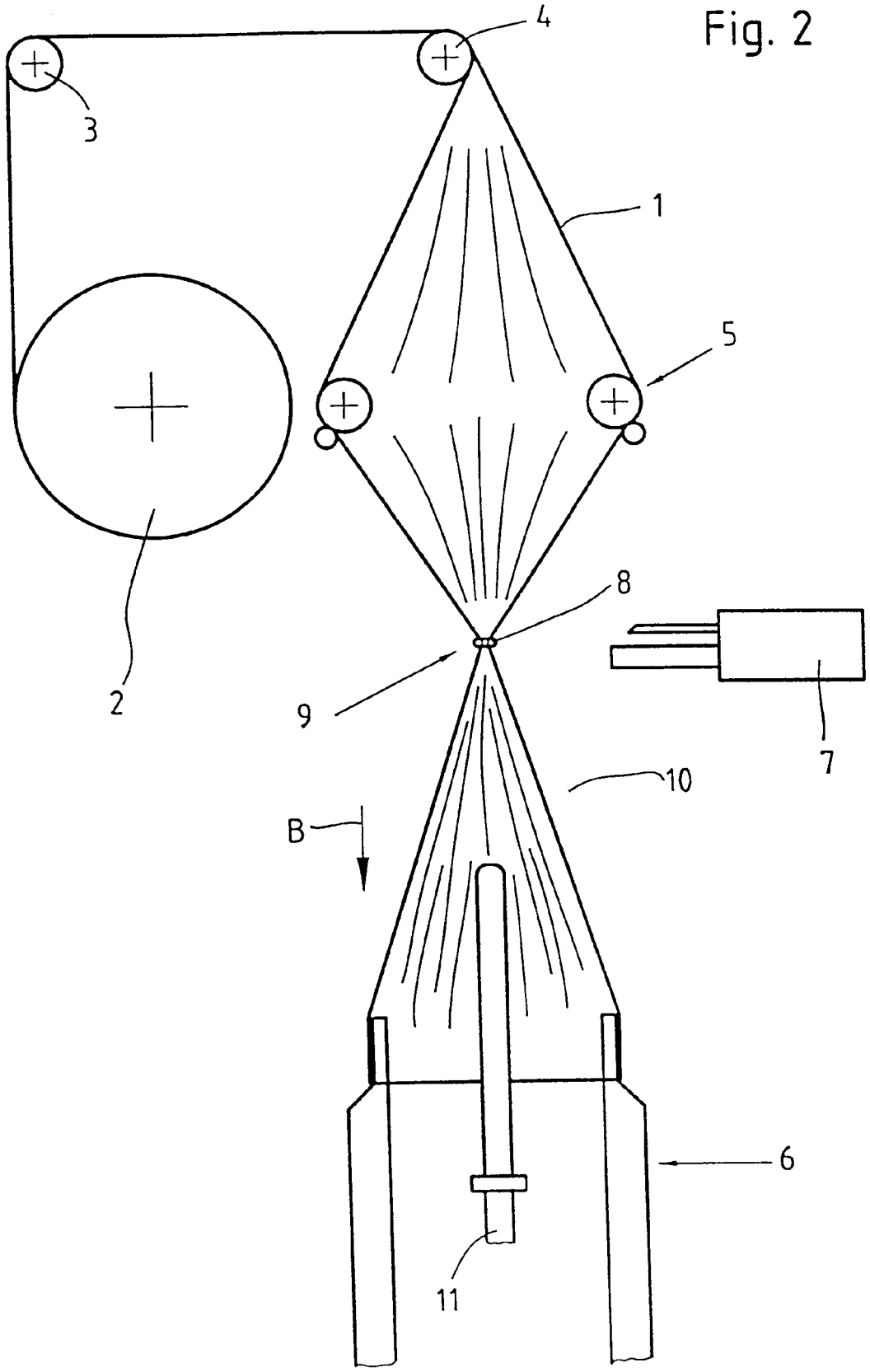
As shown in FIG. 2, the packaging tube 1 has been withdrawn for an adjustable length over the insertion pin 11 and sealed with a clip 8 at the sealing point 9.

As is shown in FIGS. 1 to 6, the inventive device for feeding a continuous tubular material 1 comprises a feeding rollers 2, 3, 4. The walls of the tubular material 1 are lying on each other, so that the tubular material 1 is wound up as compactly as possible. For opening the tubular material 1 withdrawn from the feed roller 2 in feeding direction A (see FIG. 1), there is provided at the end of the feeding line an opening means or a means 5 for widening the front end of the tubular material 1 in feeding direction A. There is furthermore provided a gripping means 6, a cutting and sealing means 7 (see FIG. 2), an insertion pin 11 as well as a suction device 16 (see FIG. 6) for extracting the air from the bag formed from the tubular material 1.

First of all, the tubular material 1 wound upon the feed roller 2 is guided via possibly existing deflection rollers 3, 4 in feeding direction A to the opening means 5, where the front opening of the tubular material 1 in feeding direction A is widened, and this widened end of the tubular material 1 is seized by the gripping means 6.

As can be taken from FIG. 2, the gripping means 6 withdraws the tubular material 1 from the feed roller 2 corresponding to an adjustable length and at the same time pulls the same in pulling direction B (see FIG. 2) over the insertion pin 11. Subsequently, the cutting and sealing means 7 is swivelled in. The tubular material 1 is gathered by the cutting and sealing means 7 and sealed with a clip 8 on a sealing point 9. At the same time, or shortly thereafter, the tubular material 1 is cut off by the cutting and sealing means 7 above the sealing point 9 with respect to the pulling direction B, so that there is obtained tubular section 10 sealed at one end.

Then, the gripping means 6 pulls the tubular section 10 sealed at one end over the insertion pin 11 in pulling direction B, until the sealing point 9 abuts against the rear end of the insertion pin 11 in pulling direction B, as shown in FIG. 3. A feeding means not represented here moves for instance a gutted chicken 12 onto the insertion pin 11 against an adjustable stop ring 13 seated on the insertion pin 11, so that part of the tubular section 10 is disposed in the aperture of the chicken 12.

As can be taken from FIG. 4, the gripping means 6 has performed an adjustable stroke in a direction against the pulling direction B up to the level of the sealing point 9, where the front end of the tubular section 10 in feeding direction A or in pulling direction B, which has been seized by the gripping means 6, is put over the chicken 12. As a result, the material of the tubular section 10 not only rests against the inner wall of the aperture of the chicken 12, which is not shown here, but the tubular section 12 also encloses the outside of the chicken 12.

Figure 5:
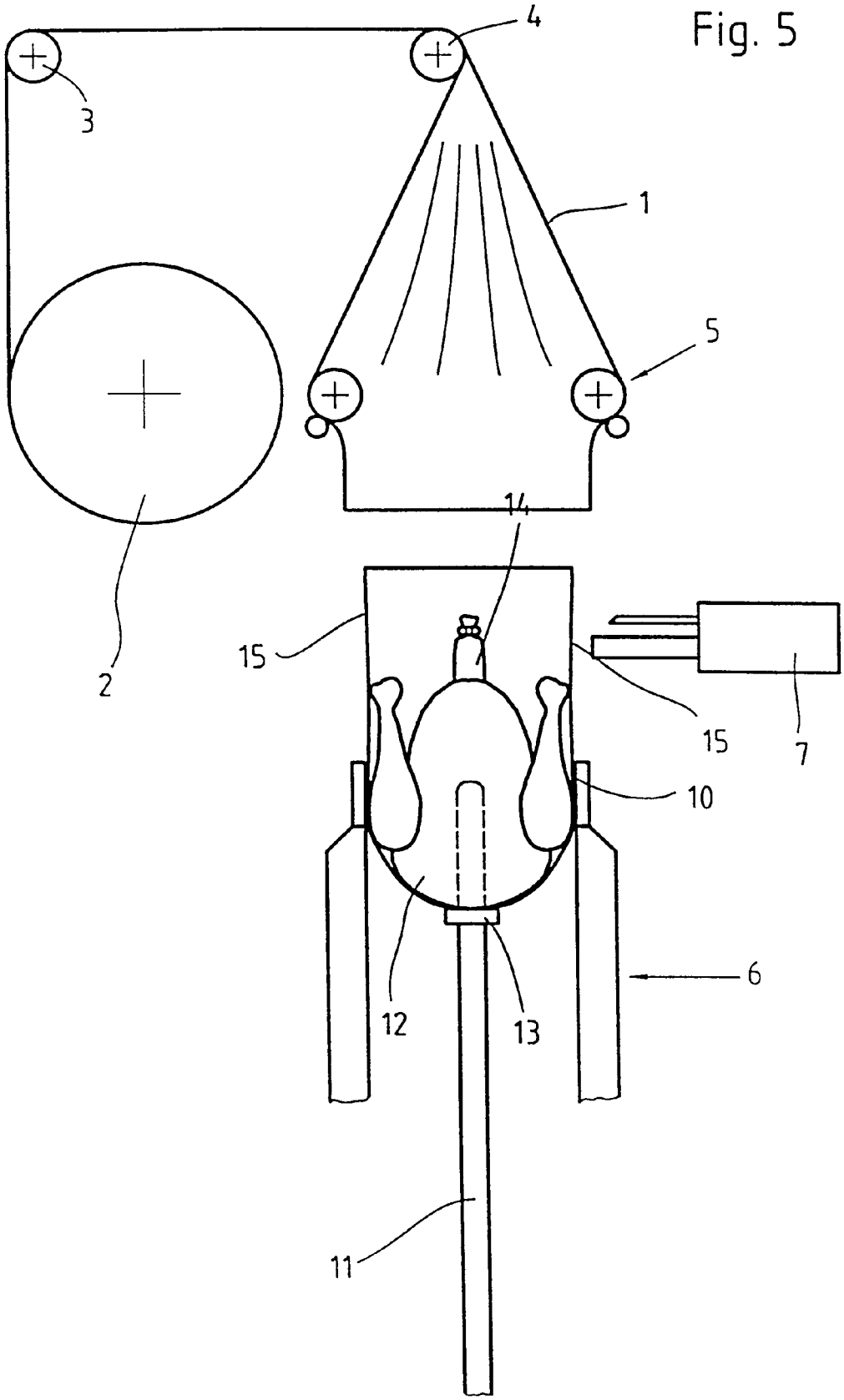
As shown in FIG. 5, the insertion pin 11 has been withdrawn by an adjustable degree. The gripping means 6 has released the packaging tube 1.
Figure 6:
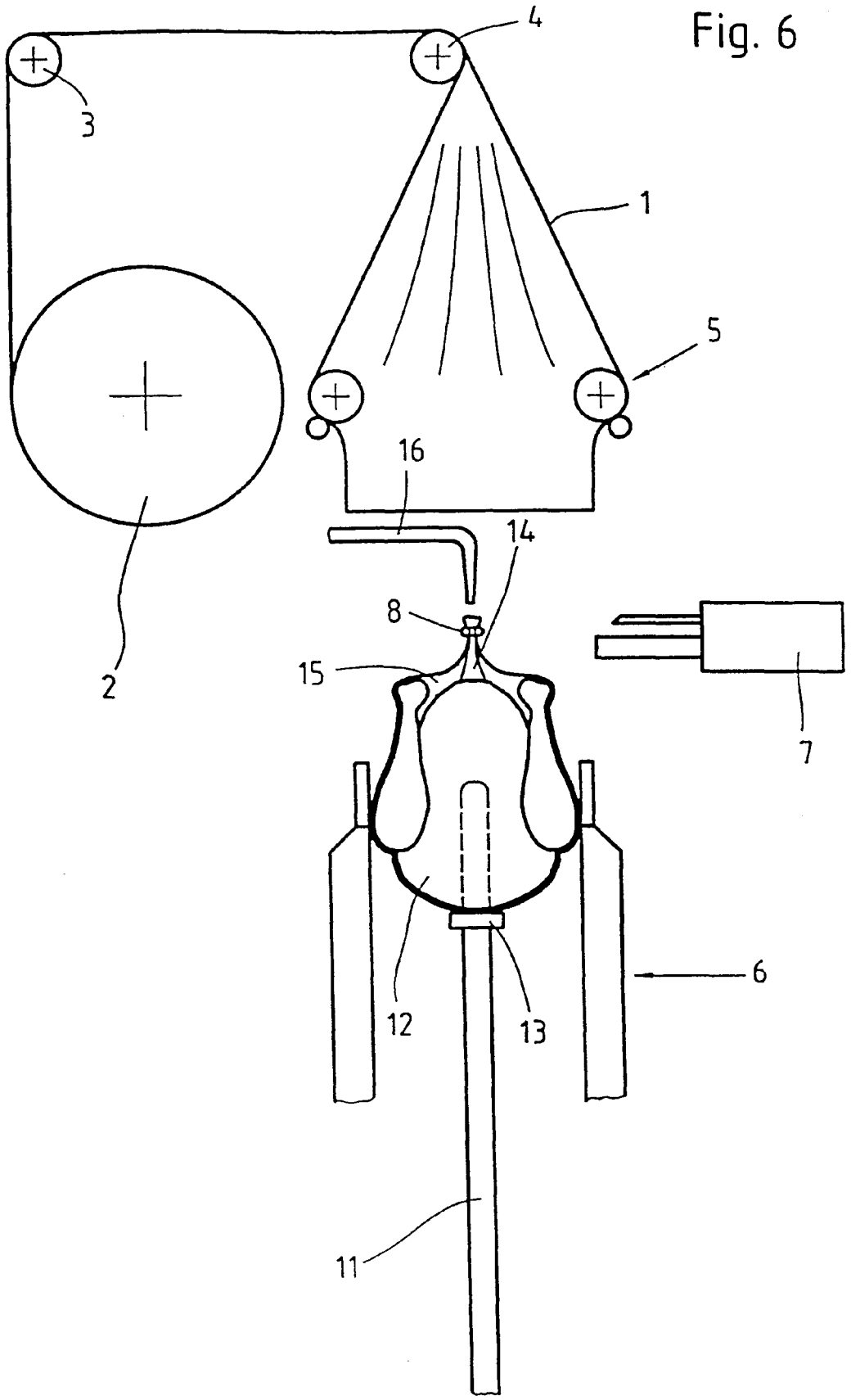
As shown in FIG. 6, air has been withdrawn from the package by means of a suction device, and subsequently the gathered packaging tube has been sealed and cut off by means of the cutting and sealing means 7.

As can be taken from FIG. 5, the gripping means 6 has released the clamping of the tubular section 10. Subsequently, the stop ring 13 and thus the chicken 12 together with the tubular section 10 are moved along the insertion pin 11 against the pulling direction B, so that the protruding parts 14, 15 of the tubular section 10 and in part the chicken 12 protrude beyond the insertion pin 11.

Subsequently, the suction device 16 is swivelled into the free space disposed before the insertion pin 11 in pulling direction B and is introduced into the aperture of the end of the tubular section 10 put over the chicken 12. It extracts the air from the interior of the bag thus formed.

By means of the pivotally mounted cutting and sealing means 7 the protruding parts 14, 15 of the tubular section 10 are gathered and vacuum-tightly sealed with a clip 8. The part of the tubular section 10 protruding beyond the clip 8 is cut off.

When the chicken 12 enclosed within the bag has been removed, the suction device 16 and the cutting and sealing means 7 have been returned to their starting position, the gripping means 6 can start with the next packaging operation.

I claim:

1. A process for packaging foodstuff having an aperture, which comprises providing a tubular section of packaging material having a sealed end and an open end, passing the sealed end through the aperture, and then bringing the open end over the foodstuff.

2. The process of claim 1, further comprising widening the open end of said tubular packaging material and pulling said tubular packaging material over one end of an insertion pin to the extent that the sealed end of said tubular packaging material covers and approximately abuts against said end of said insertion pin.

3. The process of claim 2, further comprising pushing the foodstuff onto the insertion pin after said tubular packaging material has been pulled over said insertion pin, and introducing said covered insertion pin into said aperture.

4. The process of claim 1 further comprising seizing the open end of said tubular packaging material, after passing said sealed end of said tubular packaging material through said aperture, and guiding said open end over said sealed foodstuff up to at least the sealed end of the tubular section, which has been passed through said aperture.

5. The process of claim 4 further comprising the step of sealing said open end of said tubular section of packing material after said open end is pulled over said foodstuff.

6. The process of claim 5, further comprising the step of evacuating air from said open end of said section of said tubular packaging material before sealing same.

7. The process of claim 1, further comprising forming said tubular section of packaging material by forming a film of packaging material into a tubular shape, and cutting same into lengths of tubular packaging material.

8. A device for packaging foodstuffs having an aperture, comprising an insertion pin (11), by means of which a tubular section (10) can be passed through the aperture of the foodstuff, a sealing means (7) for sealing the end of the tubular section disposed at the free end of the insertion pin (11), and gripping means by which the end of the tubular section (10) which is disposed opposite the sealed end of the tubular section (10) can be seized and put over the foodstuff (12).

9. The device as claimed in claim 8, further comprising a means (5) for widening the end of the tubular section (10) to be put over the foodstuff (12).

10. The device as claimed in claim 8, further comprising rollers (2–4) for feeding a continuous tubular material (1) to the gripping means (6), which supplies the tubular material (1) to a cutting means (7), which cuts off the tubular section (10) and optionally material protruding from the end of the tubular section (10), which has been passed over the foodstuff (12) so as to be put over the same, after the same has been sealed.

11. The device of claim 8, wherein said foodstuffs are meat, sausage products or gutted poultry.

12. The device as claimed in claim 8, wherein the inserting pin (11) comprises a stop (13) movable along longitudinal axis of the insertion pin (11).

13. The device of claim 12, wherein said stop (13) is a stop ring.

* * * * *